US006607454B2

(12) United States Patent
Maruko et al.

(10) Patent No.: US 6,607,454 B2
(45) Date of Patent: Aug. 19, 2003

(54) MULTI-PIECE SOLID GOLF BALL

(75) Inventors: Takashi Maruko, Chichibu (JP); Michio Inoue, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 09/988,668

(22) Filed: Nov. 20, 2001

(65) Prior Publication Data

US 2002/0103043 A1 Aug. 1, 2002

(30) Foreign Application Priority Data

Dec. 1, 2000 (JP) ..... 2000-366547

(51) Int. Cl.[7] ..... A63B 37/06
(52) U.S. Cl. ..... 473/374
(58) Field of Search ..... 473/374, 373, 473/367, 368, 370, 371, 376, 377

(56) References Cited

U.S. PATENT DOCUMENTS 4,337,946 A * 7/1982 Saito et al. ..... 473/356
4,431,193 A * 2/1984 Nesbitt ..... 473/374
4,919,434 A 4/1990 Saito
5,068,151 A * 11/1991 Nakamura ..... 428/407
5,314,187 A * 5/1994 Proudfit ..... 473/373
5,730,663 A * 3/1998 Tanaka et al. ..... 473/373
5,759,676 A 6/1998 Cavallaro et al.
5,779,561 A * 7/1998 Sullivan et al. ..... 473/373
5,830,086 A 11/1998 Hayashi et al.
5,873,796 A 2/1999 Cavallaro et al.
6,042,488 A * 3/2000 Sullivan et al. ..... 473/374

* cited by examiner

*Primary Examiner*—Steven Wong
*Assistant Examiner*—Raeann Gorden
(74) *Attorney, Agent, or Firm*—Sughrue Mion, PLLC

(57) ABSTRACT

A multi-piece solid golf ball comprising a rubbery elastic core and a cover enclosing the core and consisting of a plurality of resinous layers is provided. Among the plurality of cover layers, the outermost layer has a thickness of less than 1 mm and a Shore D hardness of 50–65 and an inner layer has a thickness of 0.5–2.0 mm and a Shore D hardness of 40–55. The ball is easy to control due to high-spin receptivity when hit with a short iron, and travels a distance due to restricted spin when hit with a small loft club like driver.

4 Claims, 1 Drawing Sheet

MULTI-PIECE SOLID GOLF BALL

This invention relates to a multi-piece solid golf ball having a solid core and a cover of at least two layers.

BACKGROUND OF THE INVENTION

Golf balls are generally classified into two types: the thread-wound type comprising a core having thread rubber wound around a spherical center and a cover of balata enclosing the core, and the solid type comprising a spherical rubbery elastic core and a resin cover enclosing the core. The latter is superior in flight performance when hit. The majority of golfers are in favor of solid type balls.

However, the solid golf balls have drawbacks including a hard feel when hit and less spin susceptibility when hit with a short iron. Several attempts have been made to remedy such drawbacks, for example, by reducing the hardness of the core to allow more deformation upon hitting, or inversely, by setting the hardness of the cover relatively low. It has also been attempted to enclose the core with a cover of two inner and outer resin layers, one of which is set to a lower hardness than the other (e.g., the inner layer is set to a lower hardness than the outer layer and vice versa).

In the recent years, these devices have brought fruitful results. In particular, the softened feel on hitting and spin enhancement of the dual cover structure are remarkable. However, these devices have a propensity that the flight distance which is of most interest to golfers declines with such improvements. In the current status, the advantages of the solid structure are more or less offset.

SUMMARY OF THE INVENTION

An object of the invention is to provide a multi-piece solid golf ball which is easy to control due to high-spin receptivity as in a prior art structure, when hit with a short iron, and which travels a long distance due to restricted spin when hit with a small loft angle club like a driver.

Regarding a multi-piece solid golf ball comprising a rubbery elastic core and a cover enclosing the core and consisting of a plurality of resinous layers, the present inventor has found that the ball is improved in spin performance when among the plurality of cover layers, an outer layer disposed outermost has a thickness of less than 1 mm and a Shore D hardness of 50 to 65 and an inner layer other than the outermost layer has a thickness of 0.5 to 2.0 mm and a Shore D hardness of 40 to 55. That is, due to the synergistic cooperation of the cover inner and outer layers which are optimized relative to the elastic core, the ball has improved spin performance ensuring an increase of flight distance upon driver shots and ease of control upon approach shots. Both an increase of flight distance and an improvement in ball control are accomplished.

The invention provides a multi-piece solid golf ball comprising a rubbery elastic core and a cover enclosing the core and consisting of a plurality of resinous layers, wherein among the plurality of cover layers, an outer layer disposed outermost has a thickness of less than 1 mm and a Shore D hardness of 50 to 65 and an inner layer has a thickness of 0.5 to 2.0 mm and a Shore D hardness of 40 to 55. It is noted that the inner layer represents all cover layers disposed inside the outermost layer if the cover consists of more than two layers, as will be described later.

In a preferred embodiment, the outer layer has a higher hardness than the inner layer and/or the outer layer has a smaller thickness than the inner layer. In another preferred embodiment, the outer layer is formed primarily of an ionomer resin having a melt flow rate of at least 3.0 dg/min at a temperature of 190° C., and the inner layer is formed primarily of a highly neutralized ionomer resin. Also preferably, the elastic core undergoes a deflection of 3.0 to 4.5 mm under an applied load of 980.7 N (100 kgf).

BRIEF DESCRIPTION OF THE DRAWING

The only FIGURE.

DESCRIPTION OF THE PREFERRED EMBODIMENTS

Figure 1:
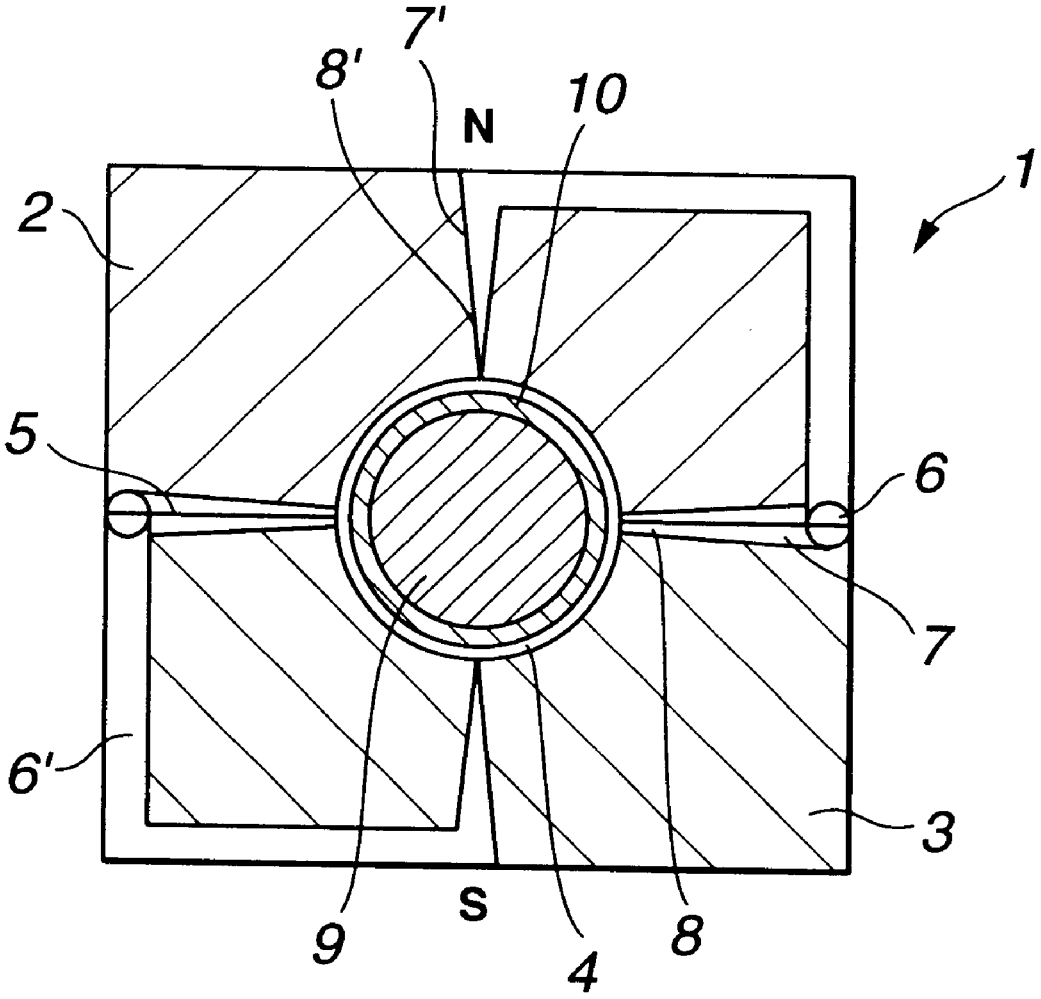
FIG. 1 is a schematic cross section of an exemplary mold for forming a cover outer layer according to the invention.

The multi-piece solid golf ball of the invention includes a rubbery elastic core and a cover enclosing the core. The elastic core can be formed from any well-known solid core material.

The elastic core material is, for example, a rubber composition comprising as a main component a base rubber composed primarily of polybutadiene, polyisoprene, natural rubber or silicone rubber. Of these, polybutadiene is preferable for increasing resilience. Of the polybutadiene, cis-1,4-polybutadiene containing at least 40% of cis-structure is preferred. If desired, another rubber component such as natural rubber, polyisoprene or styrene-butadiene rubber is blended in the polybutadiene. The other rubber component is preferably blended in amounts of less than about 10 parts by weight per 100 parts by weight of polybutadiene, in order to prevent any decline of the rebound of golf balls.

In the rubber composition, well-known components may be added to the base rubber. For example, a crosslinking agent may be blended. Exemplary crosslinking agents are zinc and magnesium salts of unsaturated fatty acids such as zinc dimethacrylate and zinc diacrylate, and esters such as trimethylpropane methacrylate. Of these, zinc diacrylate is preferred because it can impart high resilience. The crosslinking agent is preferably used in an amount of at least about 15 parts, especially at least about 20 parts by weight and up to about 40 parts, especially up to 35 parts by weight per 100 parts by weight of the base rubber.

In the rubber composition, a vulcanizing agent such as dicumyl peroxide may also be blended. It is recommended that the amount of vulcanizing agent blended be at least about 0.1 part, especially at least 0.5 part by weight and up to about 5 parts, especially up to about 2 parts by weight per 100 parts by weight of the base rubber. In the rubber composition, zinc oxide or barium sulfate may be blended as an antioxidant or specific gravity adjusting filler. The amount of filler blended is preferably at least 0 part, especially at least 5 parts by weight and up to about 80 parts, especially up to 50 parts by weight per 100 parts by weight of the base rubber.

One preferred formulation of the elastic core-forming rubber composition is given below.

| | Parts by weight |
|---|---|
| Cis-1,4-polybutadiene | 100 |
| Zinc oxide | 5 to 40 |
| Zinc diacrylate | 15 to 40 |
| Barium sulfate | 0 to 40 |
| Peroxide | 0.1 to 5.0 |

Preferred vulcanizing conditions include a temperature of 155±10° C. and a time of about 5 to 20 minutes.

Any desired method may be used to form the elastic core. The rubber composition is obtained by kneading the above-mentioned components in a conventional mixer such as a kneader, Banbury mixer or roll mill. The resulting compound is molded in a mold to form the core, using injection or compression molding technique. The vulcanizing conditions for the rubber composition are not critical although it is recommended to effect vulcanization at a temperature of 155±10° C. for about 5 to 20 minutes.

The hardness of the elastic core is not critical. In order that the elastic core exert best performance when combined with the cover inner and outer layers to be described later, it is recommended that the elastic core undergo a deflection under an applied load of 980.7 N (100 kgf) of at least 3.0 mm, especially at least 3.2 mm and up to 4.5 mm, especially up to 4.3 mm. A core with a too less deflection is too hard, sometimes adversely affecting the hitting feel. A core with a too large deflection is too soft, sometimes resulting in a substantial loss of resilience.

The golf ball of the invention has a cover including at least two inner and outer layers. With respect to the term "inner layer and outer layer" of the cover, it is noted that if the cover has a two layer structure, a cover layer directly enclosing the surface of the elastic core is designated inner layer and a concentric layer further enclosing the inner layer is designated outer layer. If the cover consists of three or more layers, only the outermost layer is designated outer layer, and the remaining layers (excluding the outermost layer) are commonly designated inner layers. With respect to the optimization of the thickness and hardness of an inner layer defined herein, when a plurality of inner layers are included, the thickness and hardness of all the inner layers combined are referred to.

The materials of which the cover inner layer is made include, for example, polyester resins, polyester elastomers, ionomer resins, styrene elastomers, polyurethane elastomers, hydrogenated butadiene resins and mixtures of any. Of these, ionomer resins, especially ionomer resins primarily comprising highly neutralized ionomer resins are recommended.

The highly neutralized ionomer resins refer to those ionomer resins in which the carboxylic acid portion is neutralized with metal ions to an extent of at least 75 mol %, preferably at least 80 mol %, and more preferably at least 85 mol %. The highly neutralized ionomer resins are obtainable by reacting ethylene-methacrylic acid-acrylic acid copolymers with a neutralizing reagent such as calcium hydroxide in a conventional manner. The highly neutralized ionomer resins in the form of ethylene-methacrylic acid-acrylic acid copolymers which are used as the cover inner layer material are commercially available, for example, under the trade name of Nucrel from Dupont-Mitsui Polychemicals Co., Ltd.

The cover inner layer can be prepared by a well-known technique, for example, injection or compression molding.

According to the invention, the cover inner layer should have a radial thickness or thickness of at least 0.5 mm, preferably at least 1.0 mm and up to 2.0 mm, preferably up to 1.5 mm. Too thin an inner layer gives rise to a durability problem. If the inner layer is too thick, the ball loses the spin reducing effect when hit with a small loft club such as a driver and provides an unpleasant feel when hit. It is recommended that the inner layer have a greater thickness than the outer layer, and this will be discussed later.

Also, the cover inner layer should have a Shore D hardness of at least 40, preferably at least 45 and up to 55. Too low a Shore D hardness leads to an increased spin and a reduced distance. Too high a Shore D hardness leads to an unpleasant feel and low rebound in a low head speed region. It is recommended that the inner layer have a lower Shore D hardness than the outer layer, and this will be discussed later.

Next, the outer layer of the cover according to the invention is the radially outermost layer of the ball. It is made of any well-known cover material. The materials of which the cover outer layer is made include, for example, ionomer resins, polyurethane resins, polyester resins, polyester elastomers, styrene elastomers, polyurethane elastomers, hydrogenated butadiene resins, and balata rubber. Of these, ionomer resins are preferable. The requirement to mold the outer layer to a very thin thickness recommends that ionomer resins have a melt flow rate (MFR) of at least 3.0 dg/min, and especially at least 4.5 dg/min, at a temperature of 190° C.

Such ionomer resins are commercially available, for example, under the trade name of Surlyn AD8511 (Zn type, MFR=5.2 dg/min) and Surlyn AD8512 (Na type, MFR=4.8 dg/min) from Dupont-Mitsui Polychemicals Co., Ltd.

The method of forming the cover outer layer is not critical. Like the inner layer, the outer layer can be formed by any well-known technique such as injection or compression molding. Injection molding is advantageously used to form the outer layer to a very thin thickness.

According to the invention, the cover outer layer should have a radial thickness or thickness of less than 1.0 mm. With too thick an outer layer, the ball loses the spin reducing effect when hit with a small loft club so that an increase of travel distance is not expectable. It is recommended that the lower limit thickness of the outer layer be at least 0.5 mm, and especially at least 0.8 mm.

In a preferred embodiment of the invention, the thickness of the outer layer is optimized together with the thickness of the inner layer. It is recommended that the thickness of the outer layer be less than that of the inner layer by a difference of 0.5 mm to 1.5 mm.

The cover outer layer should have a Shore D hardness of at least 50, especially at least 55 and up to 65, especially up to 60. With too low a Shore D hardness, the ball receives more spin and travels a reduced distance when hit with a small loft club. Too high a Shore D hardness leads to an unpleasant feel and a durability problem.

In a preferred embodiment of the invention, the Shore D hardness of the outer layer is optimized together with the Shore D hardness of the inner layer. It is recommended that the Shore D hardness of the outer layer be higher than that of the inner layer by a difference of 3 to 15 Shore D hardness units. With too small a hardness difference, the desired feel and control improving effects may be sometimes lost. Too large a hardness difference may give rise to a durability problem.

The golf balls of the invention for competition play are prepared in accordance with the Rules of Golf to a diameter of not less than 42.67 mm and a weight of not greater than 45.93 g.

EXAMPLE

Examples of the invention are given below by way of illustration and not by way of limitation.

Mold for Cover Outer Layer

FIG. 1 schematically illustrates one exemplary mold suited for the injection molding of a resin compound to a very thin thickness as in the case of the cover outer layer used in the present invention. This mold was used to mold the cover outer layer in the manufacture of sample balls within the scope of the invention as listed in Table 3.

The mold generally designated at 1 in the FIG. includes an upper mold half 2 and a lower mold half 3 which are mated along a parting plane 5 to define a cavity 4 therein. The parting plane 5 is in register with the equator of the cavity 4. A runner 6 for injection molding resin feed is disposed in the parting plane 5 and extends outside the cavity 4 so as to surround the cavity 4. Four to eight equiangularly spaced nozzles 7 (eight nozzles spaced at 45° in the illustrated embodiment) extend laterally inward from the runner 6 and terminate at gates 8 which open to the cavity 4.

Additional runners 6' extend vertically from diametrically opposite positions of the (horizontal) runner 6 to the upper and lower mold halves 2 and 3, and bend in a hook shape to define reentrant nozzles 7' at positions corresponding to the north and south poles N and S. The nozzles 7' terminate at gates 8' which open to the cavity 4.

These gates 8 and 8' (ten in total) have openings all directed toward the center of the cavity 4.

Within the cavity 4, a core 9 which has been molded in a separate mold and surface enclosed with an inner layer 10 is disposed in alignment. The cavity 4 on its wall surface is provided with a plurality of protrusions for forming a corresponding plurality of dimples and support pins are arranged for supporting the inner layer-bearing core 9 in alignment with the cavity 4 although they are omitted merely for the sake of brevity.

Manufacture of Balls

The materials shown in Tables 1 and 2 were used. An elastic core was formed in a well-known manner, and enclosed with a cover inner layer. A cover outer layer was formed around the inner layer-bearing core by injection molding. In Examples, the mold shown in FIG. 1 was used. In Comparative Examples, a well-known injection mold which was provided with a runner, nozzles and gates only in the parting plane was used. In this way, three-piece golf balls were manufactured which had the elastic core, cover inner layer and cover outer layer in the combination shown in Table 3.

The performance of the golf balls was examined as follows.

Ball Performance:

Using a swing robot equipped with a driver (W#1, loft angle 9°), the ball was hit at a head speed of 45 m/s (HS45) and 40 m/s (HS40). A spin rate, initial velocity, launch angle, carry and total distance were measured.

Also measured were the spin rate, initial velocity and launch angle of the ball when hit at a head speed of 35 m/s (HS35) using a swing robot equipped with No. 9 iron (I#9).

Hardness:

The hardness of a spherical body is expressed by a deflection (mm) under an applied load of 980.7 N (100 kgf).

The ingredients shown in Tables 1 and 2 are identified below.

1), 2) polybutadiene by JSR Corp.

3) by Nippon Shokubai Co., Ltd.

4) by Bayer AG 5) antioxidant by Ouchi-Shinkou Chemical Industry K.K.

6) vulcanization accelerator by Ouchi-Shinkou Chemical Industry K.K.

7), 8) peroxide by NOF Corp.

9) ionomer resin by Dupont-Mitsui Polychemicals Co., Ltd.

10) ionomer resin by Dupont 11) ethylene-ethyl acrylate (EEA) resin by Dupont-Mitsui Polychemicals Co., Ltd.

12) behenic acid by NOF Corp.

TABLE 1

| | Core composition (pbw) | | | | | | | |
|---|---|---|---|---|---|---|---|---|
| | A | B | C | D | E | F | G | H |
| BR11 [1] | 70.0 | 70.0 | 70.0 | 70.0 | 70.0 | 70.0 | 70.0 | 70.0 |
| BR19 [2] | 30.0 | 30.0 | 30.0 | 30.0 | 30.0 | 30.0 | 30.0 | 30.0 |
| Zinc oxide | 19.1 | 21.1 | 22.9 | 26.3 | 25.3 | 29.0 | 27.5 | 31.4 |
| Zinc diacrylate [3] | 28.5 | 28.5 | 28.5 | 28.5 | 28.5 | 28.5 | 28.5 | 28.5 |
| Bayer Renacit 4 [4] | 1.00 | 1.00 | 1.00 | 1.00 | 1.00 | 1.00 | 1.00 | 1.00 |
| NS-6 [5] | 0.05 | 0.05 | 0.05 | 0.05 | 0.05 | 0.05 | 0.05 | 0.05 |
| H [6] | 0.20 | 0.20 | 0.20 | 0.20 | 0.20 | 0.20 | 0.20 | 0.20 |
| Percumyl D [7] | 0.60 | 0.60 | 0.60 | 0.60 | 0.60 | 0.60 | 0.60 | 0.60 |
| Perhexa 3M [8] | 0.60 | 0.60 | 0.60 | 0.60 | 0.60 | 0.60 | 0.60 | 0.60 |

TABLE 2

| | Cover inner layer | Cover outer layer |
|---|---|---|
| Himilan 1605[9] | 14 | |
| Himilan 1706[9] | 14 | |
| Surlyn 8120[10] | | 20 |
| Surlyn AD8511[10] | | 50 |
| Surlyn AD8512[10] | | 30 |
| Nucrel AN4318[11] | 72 | |
| NAA222S[12] | 20 | |
| Calcium hydroxide | 3.9 | |
| Shore D hardness | 53 | 58 |
| MFR (dg/min) | 2.1 | 4.3 |

TABLE 3

| | Example | | | | Comparative Example | | | | | | |
|---|---|---|---|---|---|---|---|---|---|---|---|
| | 1 | 2 | 3 | 4 | 1 | 2 | 3 | 4 | 5 | 6 | 7 |
| Core | | | | | | | | | | | |
| Composition | A | B | C | D | C | D | E | F | G | H | H |
| Outer diameter (mm) | 39.36 | 38.59 | 38.09 | 37.00 | 38.09 | 37.00 | 37.36 | 36.40 | 36.69 | 35.78 | 35.78 |
| Weight (g) | 37.1 | 35.4 | 34.3 | 32.0 | 34.3 | 32.0 | 32.8 | 30.7 | 31.6 | 29.7 | 29.7 |
| Hardness (mm) | 3.79 | 3.62 | 3.59 | 3.86 | 3.59 | 3.86 | 3.60 | 3.57 | 3.49 | 3.53 | 3.53 |

TABLE 3-continued

| | Example | | | | Comparative Example | | | | | | |
|---|---|---|---|---|---|---|---|---|---|---|---|
| | 1 | 2 | 3 | 4 | 1 | 2 | 3 | 4 | 5 | 6 | 7 |
| Cover inner layer | | | | | | | | | | | |
| Shore D hardness | 53 | 53 | 53 | 53 | 53 | 53 | 53 | 53 | 53 | 53 | 53 |
| Thickness (mm) | 0.83 | 1.16 | 1.40 | 1.91 | 0.81 | 0.81 | 1.16 | 1.14 | 1.46 | 1.44 | 1.87 |
| Outer diameter (mm) | 41.01 | 40.92 | 40.89 | 40.82 | 39.70 | 38.63 | 39.68 | 38.69 | 39.61 | 38.67 | 39.52 |
| Weight (g) | 41.1 | 40.9 | 40.9 | 40.7 | 37.9 | 35.5 | 37.9 | 35.5 | 38.0 | 35.6 | 37.6 |
| Hardness (mm) | 3.58 | 3.32 | 3.25 | 3.34 | 3.45 | 3.62 | 3.40 | 3.34 | 3.27 | 3.24 | 3.21 |
| Cover outer layer | | | | | | | | | | | |
| Shore D hardness | 58 | 58 | 58 | 58 | 58 | 58 | 58 | 58 | 58 | 58 | 58 |
| Thickness (mm) | 0.82 | 0.86 | 0.87 | 0.90 | 1.49 | 2.03 | 1.49 | 1.99 | 1.52 | 2.00 | 1.57 |
| Outer diameter (mm) | 42.66 | 42.63 | 42.64 | 42.63 | 42.67 | 42.68 | 42.67 | 42.68 | 42.66 | 42.67 | 42.66 |
| Weight (g) | 45.1 | 45.1 | 45.2 | 45.1 | 45.4 | 45.4 | 45.5 | 45.3 | 45.7 | 45.5 | 45.5 |
| Hardness (mm) | 3.28 | 3.08 | 2.98 | 3.00 | 2.91 | 2.81 | 2.79 | 2.59 | 2.68 | 2.50 | 2.58 |
| Ball performance | | | | | | | | | | | |
| W#1/HS45 | | | | | | | | | | | |
| Spin (rpm) | 2510 | 2550 | 2570 | 2610 | 2630 | 2720 | 2660 | 2780 | 2700 | 2830 | 2740 |
| Initial velocity (m/s) | 66.50 | 66.47 | 66.43 | 66.37 | 66.54 | 66.55 | 66.52 | 66.54 | 66.50 | 66.52 | 66.46 |
| Launch angle (°) | 9.99 | 10.05 | 9.92 | 9.96 | 9.83 | 9.67 | 9.96 | 9.56 | 9.92 | 9.67 | 9.90 |
| Carry (m) | 217.0 | 216.4 | 215.8 | 215.6 | 214.9 | 214.5 | 215.2 | 214.0 | 214.2 | 213.1 | 213.1 |
| Total (m) | 236.3 | 235.5 | 234.3 | 233.2 | 232.8 | 232.0 | 232.4 | 231.3 | 231.5 | 230.0 | 230.4 |
| W#1/HS40 | | | | | | | | | | | |
| Spin (rpm) | 2570 | 2580 | 2600 | 2610 | 2650 | 2690 | 2670 | 2720 | 2690 | 2740 | 2710 |
| Initial velocity (m/s) | 58.98 | 58.96 | 58.92 | 58.87 | 59.00 | 59.00 | 58.98 | 58.99 | 58.96 | 58.98 | 58.93 |
| Launch angle (°) | 10.63 | 10.57 | 10.56 | 10.45 | 10.38 | 10.30 | 10.34 | 10.23 | 10.35 | 10.26 | 10.29 |
| Carry (m) | 185.3 | 184.8 | 184.3 | 183.8 | 183.5 | 182.3 | 183.1 | 181.8 | 182.5 | 181.5 | 181.9 |
| Total (m) | 201.2 | 200.8 | 200.0 | 199.7 | 199.1 | 197.5 | 198.7 | 197.3 | 198.5 | 196.5 | 198.0 |
| I#9/HS35 | | | | | | | | | | | |
| Spin (rpm) | 7030 | 7160 | 7210 | 7220 | 6950 | 6870 | 7090 | 7040 | 7120 | 7070 | 7160 |
| Initial velocity (m/s) | 39.71 | 39.53 | 39.31 | 39.12 | 39.50 | 39.44 | 39.39 | 39.24 | 38.12 | 39.08 | 39.03 |
| Launch angle (°) | 22.30 | 22.17 | 22.06 | 22.11 | 22.41 | 22.56 | 22.30 | 22.34 | 22.24 | 22.25 | 22.13 |

As is evident from the test results in Table 3, the multi-piece solid golf balls within the scope of the invention provide a reduced spin rate and accomplish an increase of travel distance on driver shots, but produce a comparable spin rate on short iron shots, indicating ease of control.

In contrast, the golf balls of Comparative Examples receive too much spin and travel relatively short on driver shots and/or are less easy to control on short iron shots. None of the comparative golf balls satisfied both the requirements of flight distance and controllability.

As demonstrated above, the multi-piece solid golf ball of the invention is easy to control due to high-spin receptivity as in a prior art structure, when hit with a is short iron, and travels a long distance due to restricted spin when hit with a small loft angle club like a driver.

Japanese Patent Application No. 2000-366547 is incorporated herein by reference.

Although some preferred embodiments have been described, many modifications and variations may be made thereto in the light of the above teachings. It is therefore to be understood that within the scope of the appended claims, the invention may be practiced otherwise than as specifically described.

What is claimed is:

1. A multi-piece solid golf ball comprising a rubbery elastic core and a cover enclosing the core and consisting of a plurality of resinous layers, wherein among the plurality of cover layers, an outer layer disposed outermost has a thickness of less than 1 mm and a Shore D hardness of 50 to 58 and an inner layer has a thickness of 0.5 to 2.0 mm and a Shore D hardness of 40 to 55, the outer layer has a higher hardness than the inner layer, the outer layer has a smaller thickness than the inner layer, the outer layer is formed primarily of an ionomer resin having a melt flow rate of at least 3.0 dg/min at a temperature of 190° C., and the elastic core undergoes a deflection of 3.0 to 4.5 mm under an applied load of 980.7 N (100 kgf).

2. The golf ball of claim 1 wherein the inner layer is formed primarily of a highly neutralized ionomer resin.

3. The golf ball of claim 1 wherein the Shore D hardness of the outer layer is higher than that of the inner layer by a difference of 3 to 15 Shore D hardness units.

4. The golf ball of claim 1 wherein said multi-piece solid golf ball is a three-piece golf ball.

* * * * *